US005542238A

United States Patent [19]

Johnson et al.

[11] Patent Number: 5,542,238

[45] Date of Patent: Aug. 6, 1996

[54] APPARATUS AND METHOD FOR LOADING HORIZONTAL STACKS OF CONTAINERS INTO A CARTON

[75] Inventors: Darrell B. Johnson; George E. Frey, both of Fort Collins, Colo.

[73] Assignee: CBW Automation, Inc., Fort Collins, Colo.

[21] Appl. No.: 473,002

[22] Filed: Jun. 6, 1995

[51] Int. Cl.[6] ..... B65B 5/06; B65B 35/50; B65B 39/02

[52] U.S. Cl. ..... 53/475; 53/244; 53/260; 53/449; 53/536

[58] Field of Search ..... 53/475, 474, 473, 53/244, 260, 255, 248, 247, 235, 449, 175, 542, 538, 537, 535, 536, 534

[56] References Cited

U.S. PATENT DOCUMENTS

| | | | |
|---|---|---|---|
| 2,736,477 | 2/1956 | Krebs et al. | 53/260 |
| 4,050,218 | 9/1977 | Call | 53/244 X |
| 4,215,523 | 8/1980 | Turner | 53/260 X |
| 4,671,042 | 6/1987 | Moekle et al. | 53/244 X |
| 4,805,379 | 2/1989 | Leibetseder et al. | 53/260 X |
| 4,905,456 | 3/1990 | Olaechea | 53/475 X |
| 5,410,859 | 5/1995 | Kresak et al. | 53/260 X |

*Primary Examiner*—James F. Coan
*Attorney, Agent, or Firm*—William E. Hein

[57] ABSTRACT

An apparatus for filling cartons with horizontal stacks of containers includes a chute assembly and a carton indexing table positioned thereunder. The chute assembly holds a single horizontal stack of containers to be placed in a plastic-lined carton previously placed on the carton indexing table. The chute assembly includes front and rear downwardly and inwardly projecting fixed guides and a pair of pivoting side guides. The pivoting side guides are arranged for motion between an inward retracted position and an outward extended position.

3 Claims, 4 Drawing Sheets

APPARATUS AND METHOD FOR LOADING HORIZONTAL STACKS OF CONTAINERS INTO A CARTON

BACKGROUND AND SUMMARY OF THE INVENTION

This invention relates generally to container handling systems and more specifically to a system that loads horizontal stacks of nested containers into lined or unlined cartons. Stacks of containers are typically received from a robot stacking system, a printing system, a vacuum forming system or a paper cup manufacturing system. Such stacks of containers destined for use in the medical and food service industries, for example, require horizontal placement in cartons into which plastic liners have been placed. It is critical that the plastic liner not be torn during carton filling operations. Affordable container handling systems have been mostly or completely manual, although some very expensive automative systems are known. Manual container filling is labor intensive and adds significantly to the overall cost of the containers. Known automatic systems, typically involving pick and place robots, are very expensive, difficult to adapt to different container sizes, and do not easily accommodate plastic carton liners that serve to protect the containers from contamination.

It is therefore a principal object of the present invention to provide a system for placing horizontal stacks of containers into plastic-lined cartons, without risk of tearing the plastic liners.

This and other objects are accomplished in accordance with the illustrated preferred embodiment of the invention by providing a chute assembly and a carton indexing table positioned thereunder. The chute assembly holds a single horizontal stack of containers to be placed in a plastic-lined carton previously placed on the carton indexing table. The chute assembly includes front and rear downwardly and inwardly projecting fixed guides and a pair of pivoting side guides. The pivoting side guides are arranged for motion between an inward retracted position and an outward extended position.

DETAILED DESCRIPTION OF THE INVENTION

Figure 1:
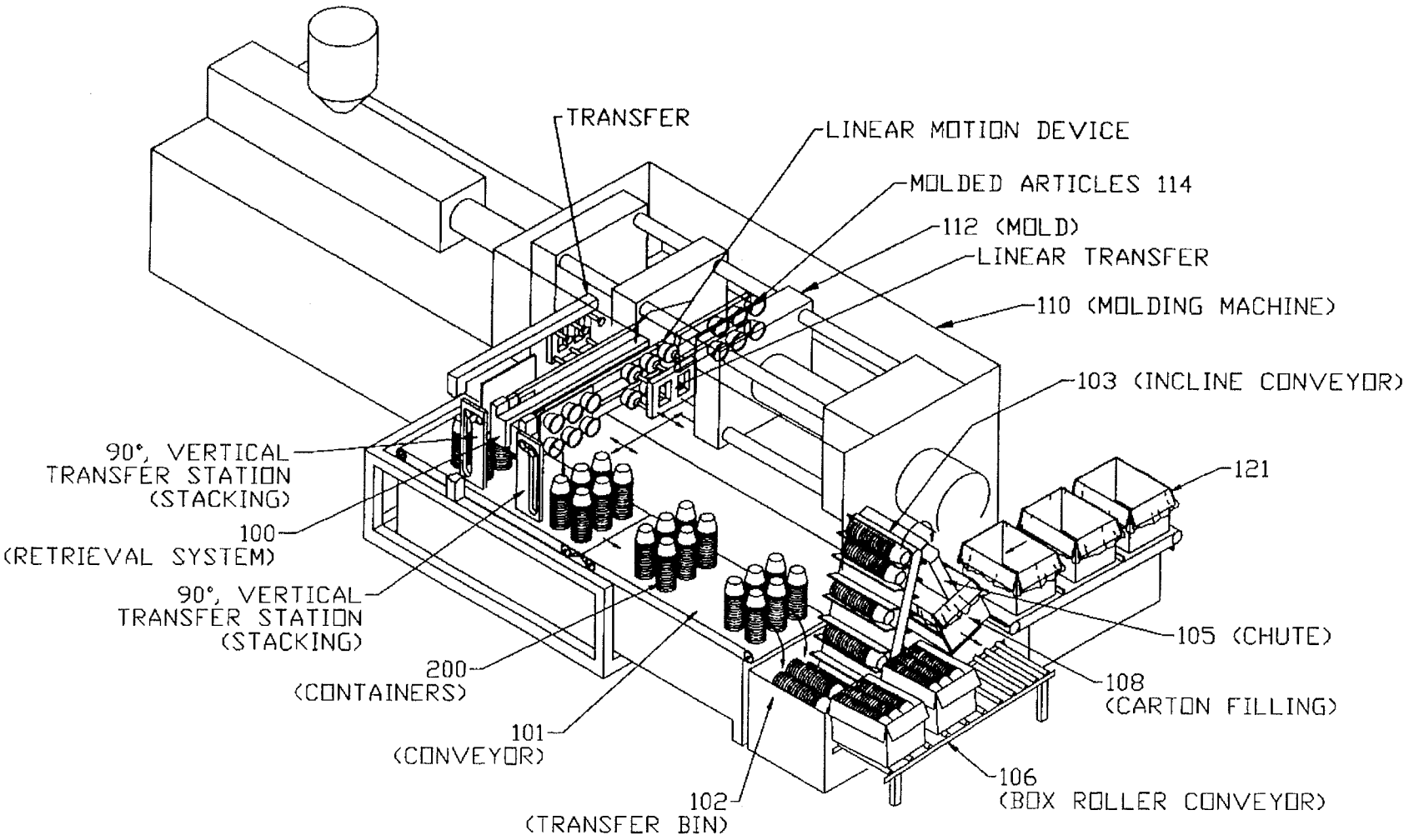
FIG. 1 is an overall pictorial diagram illustrating how the horizontal stacked container handling system of the present invention is employed in connection with a container manufacturing apparatus.
Figure 2:
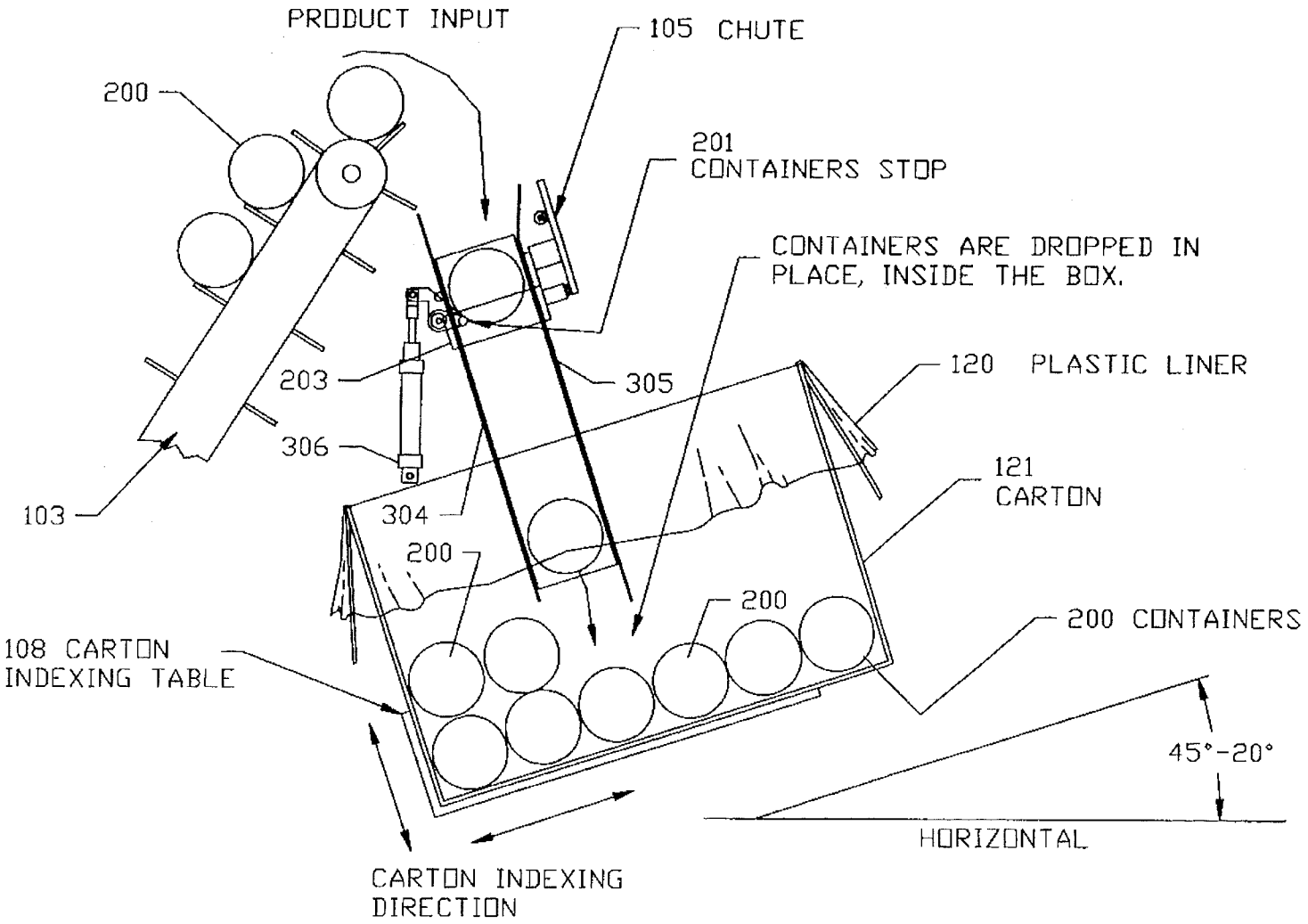
FIG. 2 is a detailed pictorial diagram illustrating how the horizontal stacked container handling system of FIG. 1 is employed to load horizontal stacks of containers into a plastic-lined carton.

Referring now generally fo FIGS. 1–4, there is shown a conventional retrieval system 100 positioned adjacent a conventional plastic molding machine 110. A multiplicity of containers 200 are conventionally removed from the molding machine 110 and stacked in vertical columns. The vertical columns of containers 200 advance to the end of a conveyor 101, at which point they are dropped or otherwise placed in horizontal stacks in a transfer bin 102. A cleated incline conveyor 103 positioned at approximately a 70-degree angle transports the horizontal stacks of containers 200 up to a chute 105. A plurality of empty cartons 121 with plastic liners 120 previously placed therein are conveyed onto a carton indexing table 108. Carton indexing table 108 is arranged by conventional means for rotation and for horizontal and vertical translation, as indicated in FIG. 2.

Figure 3:
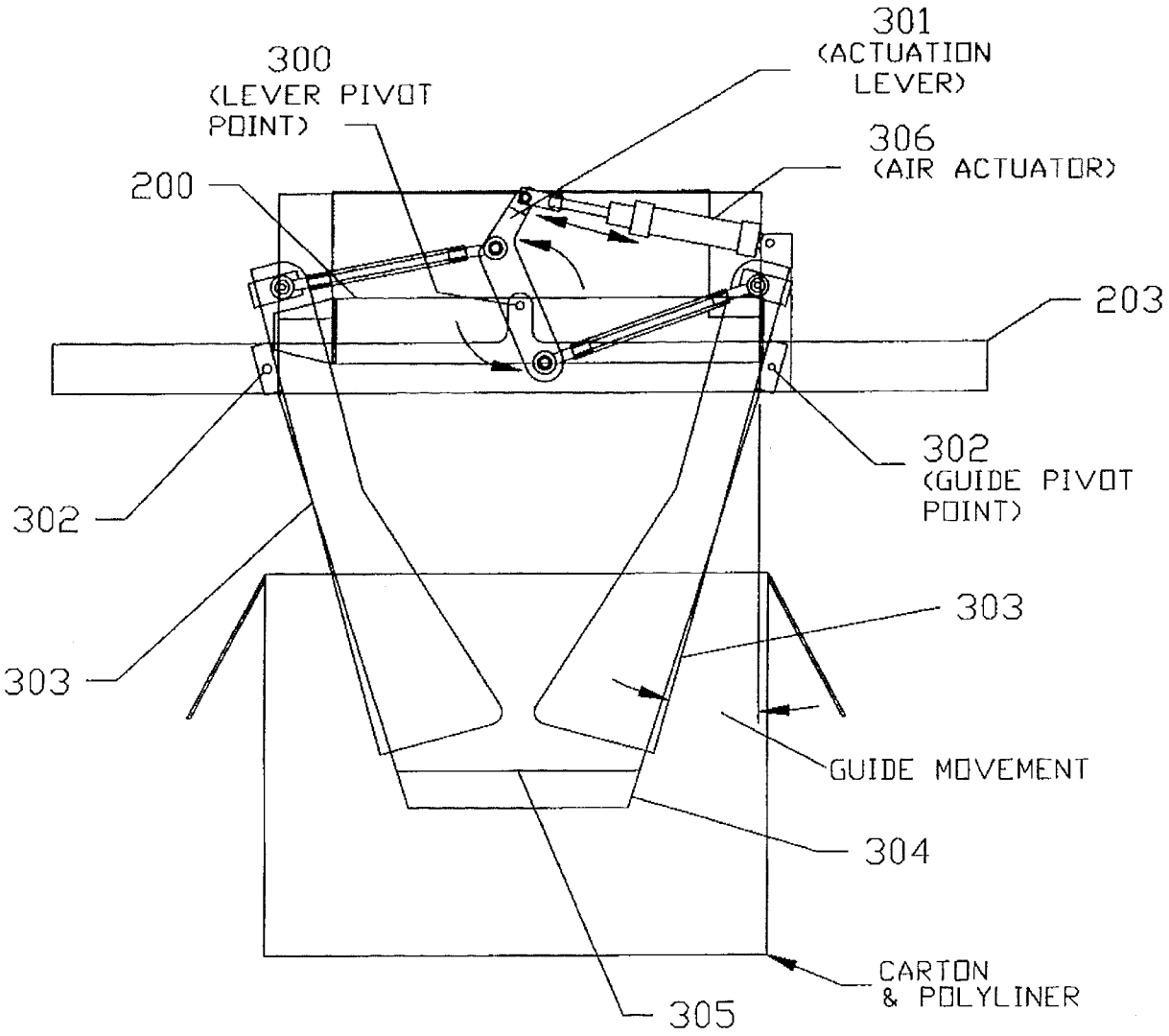
FIG. 3 is a detailed pictorial diagram illustrating a feed chute member, in the closed position, of the stacked container handling system of FIGS. 1 and 2.
Figure 4:
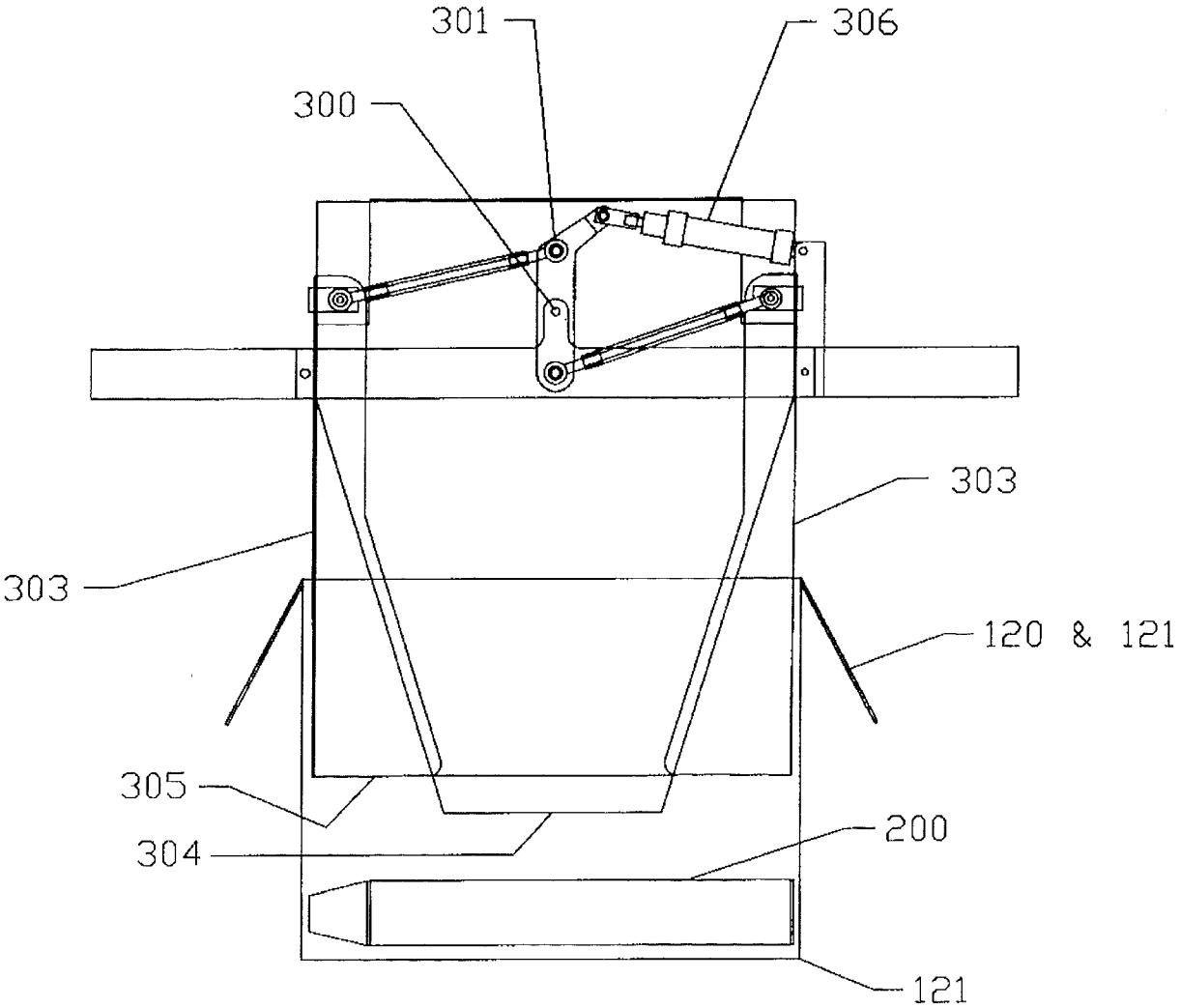
FIG. 4 is a detailed pictorial diagram illustrating the feed chute member of FIG. 3 in the open position.

Referring now more specifically to FIGS. 2–4, chute 105 is positioned above carton indexing table for sequentially dropping each horizontal stack of containers 200 received from conveyor 103 into carton 121. When a plastic liner 120 is placed, either manually or automatically, into one of the cartons 121, trapped air inside the carton causes the plastic liner to interfere with the horizontal stacks of containers 200 if they are placed into the cartons 121 by prior art means. In order to prevent this interference, chute 105 includes a pair of side guides 303 that are arranged on opposite sides of chute 105 to pivot about pivot points 302 such that side guides 303 move outwardly and inwardly. Movement of side guides 303 is accomplished by coupling them through an actuator lever 301 to an air actuator 306. Chute 105 also includes a downwardly and inwardly projecting fixed rear guide 304 and a corresponding downwardly and inwardly projecting fixed front guide 305 positioned such that side guides 303 move within them. A container stop 201 is mounted on a support 203 for retaining each horizontal stack of containers 200 is position at the top of chute 105 until carton 121 is correctly positioned on carton indexing table 108 and the side guides 303 are extended outwardly. The container stop 201 is then raised upwardly to straighten the horizontal stack of containers 200 prior to releaing it to be dropped down chute 105 into position in carton 121.

In performing a carton filling operation, a carton 121 with a plastic liner 120 previously positioned therein is conveyed onto carton indexing table 108. Carton indexing table 108 then tilts the carton 121 to a position that is 20–45 degrees above the horizontal, as illustrated in FIG. 2. The carton indexing table 108 then translates carton 121 forwardly and upwardly such that chute 105 is in position to drop the first horizontal stack of containers 200 retained therein into the lowest corner of carton 121. As carton 121 i s being translated by indexing table 108, rear fixed guide 304 gently pushes the plastic liner 120 to remove air previously trapped between the plastic liner 120 and the side walls of carton 121. After carton 121 has been translated into position to receive the first horizontal stack of containers 200, air actuator 306 is operated to extend side guides 303 outwardly from the retracted position shown in FIG. 3 to the extended position shown in FIG. 4 to thereby push the plastic liner 120 against the side walls of carton 121 and to permit the first horizontal stack of containers retained in chute 105 to drop into place without touching, and possibly catching, the plastic liner 120. Following release of the first horizontal stack of containers 200 into carton 121, side guides 303 are retracted inwardly to the retracted position shown in FIG. 3, and the carton indexing table 108 translates carton 121 into position for accepting a second horizontal stack of containers 200 adjacent the first. This process is repeated until carton 121 is filled with rows of horizontal stacks of containers 200, at which time carton 121 will be rotated by carton indexing table 108 into the horizontal position and translated onto a box roller conveyor 106, illustrated in FIG. 1.

We claim:

1. An apparatus for sequentially loading horizontal stacks of containers into a carton, the apparatus comprising:

a feed chute assembly for receiving and releasably retaining a single horizontal stack of containers, the feed chute assembly comprising front and rear downwardly and inwardly projecting fixed guides and a pair of pivoting side guides controllably arranged for motion between an inward retracted position and an outward extended position, the feed chute assembly further comprising container release means for contollably releasing the horizontal stack of containers retained therein after the pivoting side guides have moved to the outward extended position; and a carton indexing table positioned beneath the feed chute assembly for holding the carton in place for loading, the carton indexing table being operative for rotation to a predetermined angle above a horizontal position and for horizontal and vertical translation.

2. A method for loading a horizontal stack of containers into a carton, the method comprising:

providing a feed chute assembly for receiving and releasably retaining a single horizontal stack of containers, the feed chute assembly including front and rear downwardly and inwardly projecting fixed guides and a pair of pivoting side guides controllably arranged for motion between an inward retracted position and an outward extended position, the feed chute assembly further comprising container release means for contollably releasing the horizontal stack of containers retained therein;

providing a carton indexing table positioned beneath the feed chute assembly for holding the carton in place for loading, the carton indexing table being operative for rotation to a predetermined angle above a horizontal position and for horizontal and vertical translation;

placing a plastic liner inside the carton;

placing the carton on the carton indexing table;

rotating the carton indexing table to a predetermined angle of tilt;

translating the carton indexing table horizontally and upwardly such that the chute is in position to drop a row of stacked containers retained therein into a desired position within the carton; and actuating the side guides from the retracted position to the extended position against the plastic liner to thereby remove any air trapped between the plastic liner and the carton; and releasing the horizontal stack of containers retained with the chute to permit them to drop, guided by the front and rear fixed guides and the extended side guides, into the carton.

3. A method for loading horizontal stack of containers into a carton, the method comprising:

providing a feed chute assembly for receiving and releasably retaining a single horizontal stack of containers, the feed chute assembly including front and rear downwardly and inwardly projecting fixed guides and a pair of pivoting side guides controllably arranged for motion between an inward retracted position and an outward extended position, the feed chute assembly further comprising container release means for contollably releasing the horizontal stack of containers retained therein;

providing a carton indexing table positioned beneath the feed chute assembly for holding the carton in place for loading, the carton indexing table being operative for rotation to a predetermined angle above a horizontal position and for horizontal and vertical translation;

placing the carton on the carton indexing table;

rotating the carton indexing table to a predetermined angle of tilt;

translating the carton indexing table horizontally and upwardly such that the chute is in position to drop a row of stacked containers retained therein into a desired position within the carton; and actuating the side guides from the retracted position to the extended position; and releasing the horizontal stack of containers retained with the chute to permit them to drop, guided by the front and rear fixed guides and the extended side guides, into the carton.

* * * * *